United States Patent [19]

Ohashi

[11] Patent Number: 4,709,310

[45] Date of Patent: Nov. 24, 1987

[54] SWITCH STRUCTURES IN PORTABLE FLASHLIGHTS

[75] Inventor: Keiichi Ohashi, Shizuoka, Japan

[73] Assignee: Skylite Industry Co., Ltd., Shizuoka, Japan

[21] Appl. No.: 861,411

[22] Filed: May 9, 1986

[30] Foreign Application Priority Data

Jul. 22, 1985 [JP] Japan ..... 60-161718

[51] Int. Cl.[4] ..... F21L 7/00

[52] U.S. Cl. ..... 362/205; 362/204; 200/60; 200/153 P

[58] Field of Search ..... 362/204, 205, 208; 200/60, 153 P, 362.1; 315/32

[56] References Cited

U.S. PATENT DOCUMENTS

| | | | |
|---|---|---|---|
| 1,598,666 | 9/1926 | Vorhees | 362/205 |
| 1,674,650 | 6/1928 | Leier | 200/60 |
| 2,151,910 | 3/1939 | Graubner | 200/60 |
| 2,464,184 | 3/1949 | Pearce | 200/60 |
| 2,466,414 | 4/1949 | Gits et al. | 362/205 |
| 2,832,968 | 5/1968 | Knudsen | 362/205 |
| 3,651,293 | 3/1972 | Hoffman | 200/153 P |
| 4,573,029 | 2/1986 | Naimer et al. | 200/135 P |
| 4,581,686 | 4/1986 | Nelson | 362/204 |
| 4,617,437 | 10/1986 | DuRocher | 200/153 P |

*Primary Examiner*—Raymond A. Nelli

*Attorney, Agent, or Firm*—Wegner & Bretschneider

[57] ABSTRACT

A mount structure for a suspender strap of a portable flashlight includes a female member integrally provided on the body of the flashlight and the male member detachably fitted over the female member by suitable means in a sliding fashion.

1 Claim, 4 Drawing Figures

SWITCH STRUCTURES IN PORTABLE FLASHLIGHTS

FIELD OF THE INVENTION

The present invention relates generally to a switch structure in a portable flashlight and, more particularly, to such a switch structure that is made waterproof.

BACKGROUND OF THE INVENTION

Portable flashlights are used for the prevention of disasters and the maintenance of public security at night, and are thus made waterproof so as to enable them to be used in rainy weather. As disclosed in Japanese Utility Model Publication No. 58-24353, a push button switch fitted thereover with a rubber cap is applied to the prior art portable type flashlights. This system assures a sufficient waterproofing effect for a switch portion. However, while this type of switch structure may be applied to portable flashlights of the type that have a large inner space, it cannot be applied to portable flashlights of the slide type switch, which have a wide range of mobility and are easy to handle, because the push button projects from the body, and a large inner switchover mechanism is provided. For that reason, it is desired that the prior art slide type switch should be of the waterproof structure.

However, the reason why the prior art slide type switch cannot be made waterproof is that, as shown in FIG. 4, integral connection is made between a slide button 2 and a switchover hook 3, both mounted on the upper face of a switch portion of a body 1, via a rod 4, so that, when to-and-fro movement of the slide button 2 takes place, the switchover hook 3 moves to-and-fro together with the rod 4 in operable association with the push button 2. In other words, it is required to provide a slit 5 for to-and-fro movement of the rod 4 in a portion of the switch mount of the body 1. However, it is not possible to make that slit waterproof.

SUMMARY OF THE INVENTION

It is therefore a main object of the present invention to provide a solution to the aforesaid problem.

According to the present invention, this object is achieved by the provision of a switch structure in a portable flashlight, which includes:

- a body;
- a rotating pin extending through a suitable portion of said body;
- an O-ring fitted onto said rotating pin to make the through-hole in said body waterproof;
- a roller mounted on a portion of said rotating pin extending from said body;
- a cap-like slide button fitted thereover;
- a keep hook provided at the lower end of said rotating pin; and
- a ratchet formed on one inner face of said slide button,
- said ratchet being engaged with the outer face of said roller for to-and-fro movement of said slide button, whereby said roller is reciprocally turned through an angle of about 90°, and the resulting rotation is transmitted to said keep plate via said rotating pin.

BRIEF DESCRIPTION OF THE DRAWINGS

For a better understanding of the present invention, the preferred embodiments thereof will now be explained with reference to the accompanying drawings, which are given for the purpose of illustration alone, and in which.

PREFERRED EMBODIMENTS OF THE INVENTION

Figure 1:
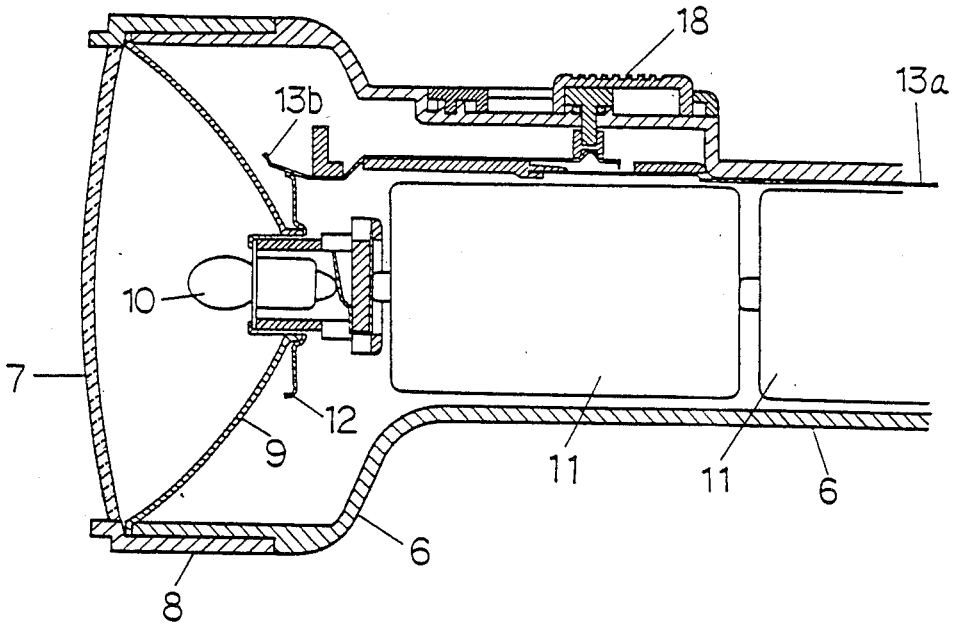
FIG. 1 is a longitudinally sectioned view showing one embodiment of the present invention.

In the drawings, reference numeral 6 stands for a body, 7 a lens, 8 a lens cover, 9 a reflector and 10 shows an electric bulb. These parts are quite similar to those used in the prior art. More specifically, the body 6 contains 2 to 4 dry batteries 11, and a lead 13 is provided between the bottom of the body 6 and a terminal plate 12 to conduct one terminal of the batteries 11 to the bulb 10. The lead 13 forms a part of a switch mechanism, and is divided into one portion 13*a* for connection to one terminal of the batteries 11 and the other portion 13*b* for connection to the terminal plate 12. The upper and lower sides of the divisional line provide switch contacts. The one lead portion 13*a* is free at the end to the body, and the other lead portion 13*b* is set free at the end, and is spaced slightly away from the lead portion 13*a* in the absence of any load. A short-circuit takes place between the lead portions 13*a* and 13*b* by the engagement of both to put the bulb on.

Referring then to the switch mechanism, it serves to convert to-and-fro movement of a slide button into the rotational force of a rotating pin, which in turn engages the lead portion 13*b* with the lead portion 13*a* for short-circuiting. In the vicinity of the end portion of the lead portion 13*b*, there is an angle projection 14, and on the upper portion thereof there is a rotating pin 15 extending through the body 6. As already stated, the pin 15 transmits to-and-fro movement of the slide button to the lead portion 13*a* for forcing it down, and renders the flashlight waterproof. More specifically, an O-ring 21 is fitted over the mounting portion of the rotating pin 15. Furthermore, that pin 15 is provided at the lower end with a keep hook 16 for engagement with the projection 14 extending from the lead portion 13*b*. The pin 15 is also integrally provided at a portion extending from the body 6 with a roller 17. Reference numeral 18 is a slide button. As is the case with the slide button 2 used in the prior art, this button 18 is mounted to the body 6 for to-and fro movement. According to this embodiment, however, the button 18 is in the form of a cap-like lid, which includes a ratchet 19 on one inner face thereof. On the other hand, the roller 17 is provided on the outer face with a number of ratchet teeth. When to-and-fro movement of the slide button 18 takes place in a state where the ratchet teeth mate with the ratchet 19 on the slide button, the roller 17 is turned through an angle of about 90°. It is to be noted that the keep plate 16 is provided on the lower face with an indent 20 of a /‾\ shape corresponding to the shape of the projection 14 of the lead 13*b*, and is mounted on the pin 15 in such a manner that when the slide button 18 is retracted, the projection 14 comes into engagement within the indent 20.

Figure 2:
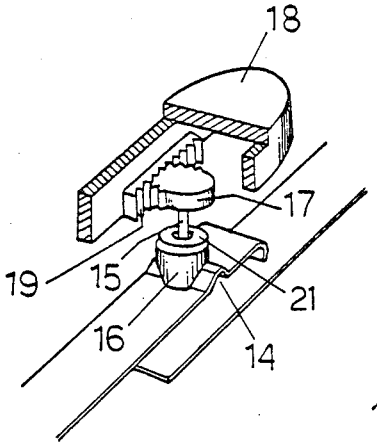
FIG. 2 and FIG. 3 are perspective views showing part of that embodiment.
Figure 3:
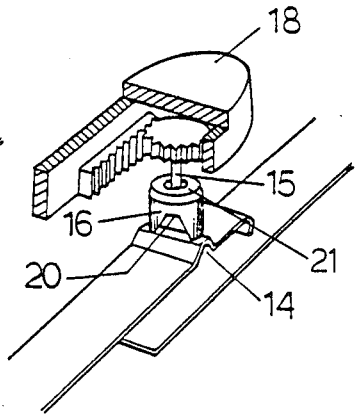
Figure 4:
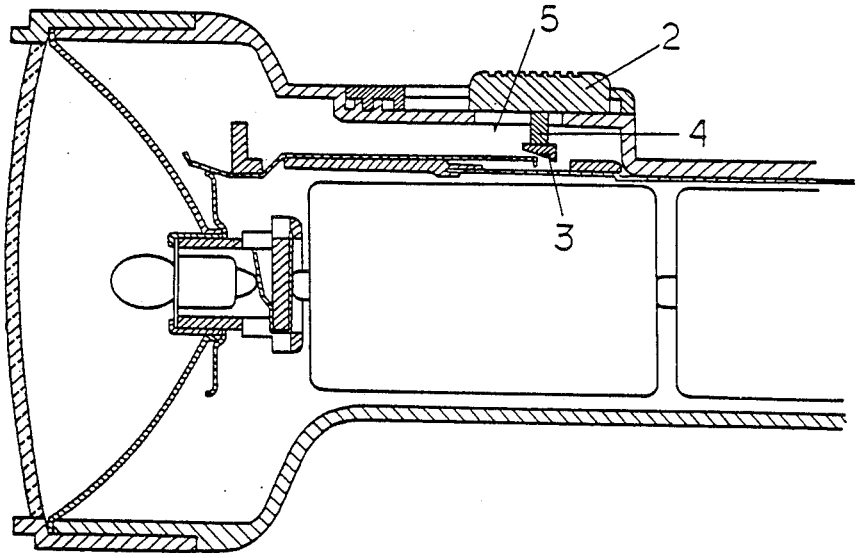
FIG. 4 PRIOR ART
FIG. 4 is a longitudinally sectioned view showing one example of the prior art portable flashlight.

FIGS. 1 and 2 illustrate the slide button 18 in its retracted state. In this state, the projection 14 is engaged within the indent 20 in the keep hook 16, and the lead portion 13*b* is spaced away from the lead portion 13*a*.

Subsequent advancement of the slide button 18 causes an about 90° turning of the roller 17, the rotational force of which is transmitted to the hook 16 via the rotating pin 15, resulting in about 90° turning of the hook 16. Thereupon, the projection 14 abuts upon both skirts of the indent 20, so that the lead portion 13*b* is forced down. Then, the lead portion 13*b* comes into contact with the lead portion 13*a* for the conduction of the lead 13, whereby the bulb 10 is switched on.

According to the embodiment as mentioned in the foregoing, the rotating pin 15 is mounted in a suitable portion of the body 6, and is turned by to-and-fro movement of the slide button 18 for turning, whereby the resulting rotational force effects switchover of the switch. It is thus possible to provide sealing between the rotating pin 15 and the through-hole with the O-ring 21 as carried out in the prior art, whereby the flashlight arrangement is made waterproof for use in rainy weather or water.

While the present invention has been described with reference to its preferred embodiment, it is understood that many modifications or changes may be made without departing from the scope as defined in the appended claim.

What is claimed is:

1. A switch structure in a portable flashlight, which includes:

a body;

a rotating pin extending through a suitable portion of said body;

an O-ring fitted onto said rotating pin to make the through-hole in said body waterproof;

a roller mounted on a portion of said rotating pin extending from said body;

a cap-like slide button fitted thereover;

a keep hook provided at the lower end of said rotating pin; and a ratchet formed on one inner face of said slide button, said ratchet being engaged with the outer face of said roller for to-and-fro movement of said slide button, whereby said roller is reciprocally turned through an angle of about 90°, and the resulting rotation is transmitted to said keep hook via said rotating pin.

* * * * *